US007131433B1

(12) United States Patent
Lindberg et al.

(10) Patent No.: US 7,131,433 B1
(45) Date of Patent: Nov. 7, 2006

(54) POSITIVE CRANKCASE VENTILATION VALVE ASSEMBLY

(75) Inventors: Michael P Lindberg, Northville, MI (US); Scott L Rossmiller, Farmington Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/144,579

(22) Filed: Jun. 3, 2005

(51) Int. Cl.
*F01M 13/04* (2006.01)

(52) U.S. Cl. ..... 123/572; 123/573; 123/574

(58) Field of Classification Search ..... 123/572, 123/573, 574
See application file for complete search history.

(56) References Cited

U.S. PATENT DOCUMENTS 3,087,474 A * 4/1963 Catha ..... 123/573
3,721,069 A * 3/1973 Walker ..... 55/319
4,844,032 A * 7/1989 Groeger et al. ..... 123/574
4,886,019 A * 12/1989 Davis et al. ..... 123/574
5,617,834 A * 4/1997 Lohr ..... 123/572
5,881,686 A * 3/1999 Schmidt ..... 123/574
6,431,159 B1 * 8/2002 Nishi et al. ..... 123/572

* cited by examiner

*Primary Examiner*—Erick Sols
(74) *Attorney, Agent, or Firm*—Thomas A. Jurecko

(57) ABSTRACT

A positive crankcase ventilation valve assembly is provided. The positive crankcase ventilation valve assembly includes a housing having a first end and a second end and a flow path therebetween. A positive crankcase ventilation valve is provided and positioned relative to the housing first end and in fluid communication with the housing flow path. A baffle is provided and positioned in the housing and in fluid communication with the housing flow path, wherein the baffle is arranged to allow crankcase gases to flow through the baffle and into the positive crankcase ventilation valve while preventing engine oil from traveling beyond the baffle.

17 Claims, 2 Drawing Sheets

POSITIVE CRANKCASE VENTILATION VALVE ASSEMBLY

FIELD OF INVENTION

The present invention relates generally to crankcase ventilation valves, and, more particularly, to an improved positive crankcase ventilation valve assembly.

BACKGROUND OF INVENTION

Crankcase ventilation valves are generally utilized to vent crankcase gases from an internal combustion engine and route the gases to an intake manifold. Positive crankcase ventilation valves typically meter a flow of gases from the crankcase to the intake manifold. Existing positive crankcase ventilation valves have been known to freeze in a closed position in cold climates thus preventing ventilation of crankcase gases until the valve un-freezes. Positive crankcase ventilation valves are also known to experience oil contamination in the valve itself as well as in the intake manifold and a hose that routes the gases from the valve to the intake manifold. To counter this situation positive crankcase ventilation valves have been known to be attached to a top of an engine cylinder head cover and shields or deflectors have been incorporated into the structure of the cylinder head cover in an attempt to prevent oil from reaching the positive crankcase ventilation valve while still allowing the crankcase gases to reach and flow through the valve.

One result of this arrangement is that by positioning the positive crankcase ventilation valve on the cylinder head cover, the valve is placed away from the heat of the engine and is thus more susceptible to freezing as well as taking a longer time to un-freeze. In addition, incorporation of shields or deflectors in the cylinder head covers adds cost and complexity to the engine assembly and limits where a positive crankcase ventilation valve can be positioned on the engine.

Thus, there is a need for an improved positive crankcase ventilation valve assembly that overcomes the above-mentioned and other disadvantages.

SUMMARY OF INVENTION

Accordingly, an improved positive crankcase ventilation valve assembly is provided. In accordance with one aspect of the present invention, the positive crankcase ventilation valve assembly includes a housing having a first end and a second end and a flow path therebetween. A positive crankcase ventilation valve is provided and positioned relative to the housing first end and in fluid communication with the housing flow path. A baffle is provided and positioned in the housing and in fluid communication with the housing flow path, wherein the baffle is arranged to allow crankcase gases to flow through the baffle and into the positive crankcase ventilation valve while preventing engine oil from traveling beyond the baffle.

BRIEF DESCRIPTION OF DRAWINGS

Other aspects, features, and advantages of the present invention will become more fully apparent from the following detailed description of the preferred embodiment, the appended claims, and in the accompanying drawings in which:

DETAILED DESCRIPTION OF EXEMPLARY EMBODIMENT(S)

Figure 1:
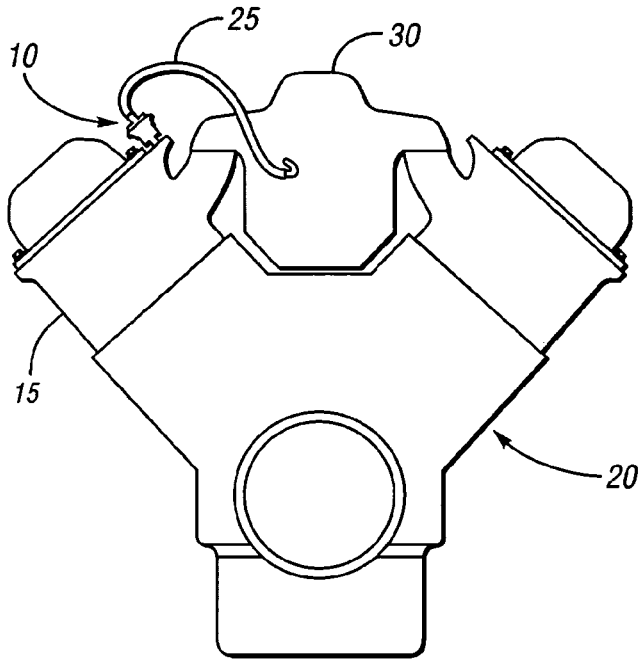
FIG. 1 illustrates a front view of an exemplary engine assembly having a positive crankcase ventilation valve assembly in accordance with the present invention.
Figure 2:
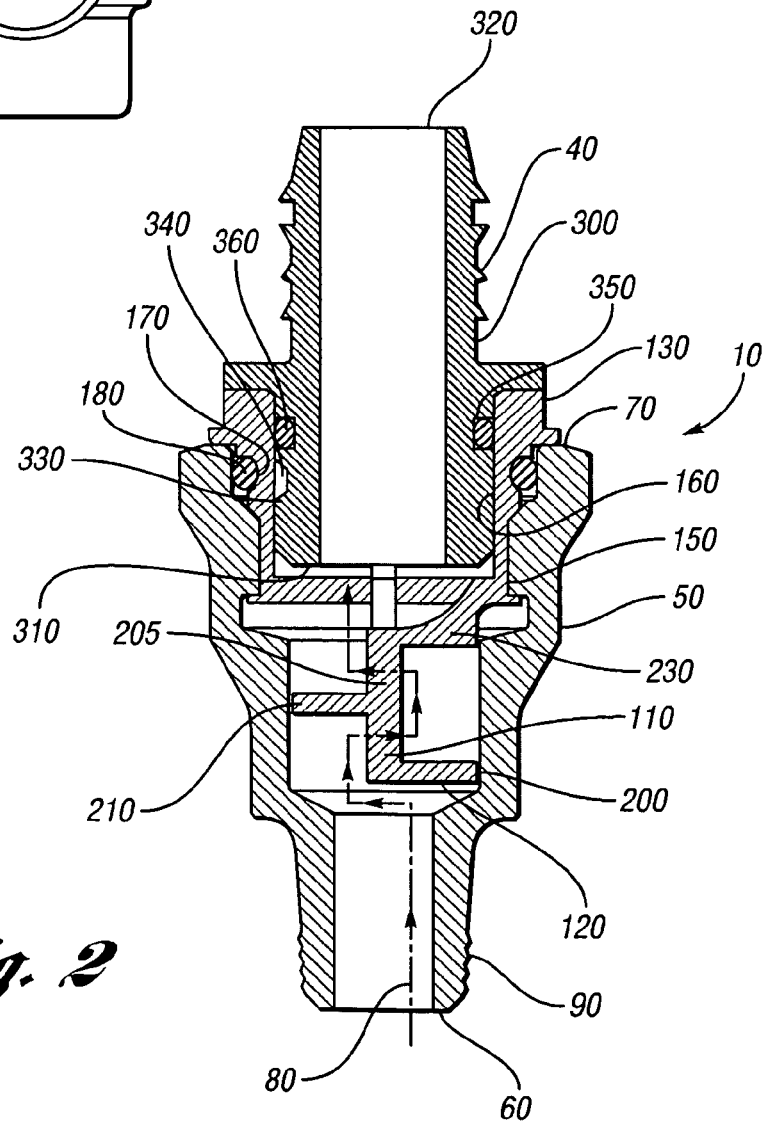
FIG. 2 illustrates a sectional view of the positive crankcase ventilation valve assembly in accordance with the present invention.

In the following description, several well-known features of an internal combustion engine are not shown or described so as not to obscure the present invention. Referring now to the drawings, FIGS. 1–3 illustrate an exemplary embodiment of a positive crankcase ventilation valve assembly 10 affixed to a cylinder head 15 of an engine assembly 20 whereby crankcase gases are routed from the positive crankcase valve assembly 10 via hose 25 to an intake manifold 30.

The positive crankcase ventilation valve assembly 10 includes a positive crankcase ventilation valve 40 and a housing 50 that provides structure and function for the assembly. Housing 50 is preferably constructed or molded from a plastic material such as a thermoset or thermoplastic material. Housing 50 has a first end 60 and a second end 70 with a general flow path 80 therebetween. Housing first end 60 is arranged to be fixedly attached to an engine in a conventional manner such as using external threads 90 and being threadably attached to a threaded bore (not shown) in the engine. Alternatively, housing first end 60 could have internal threads (not shown) that threadably attach to an externally threaded pipe fitting (not shown) protruding from the engine. It should be appreciated that other methods for attaching housing 50 to an engine have been contemplated such as having the housing integrally formed as part of an engine assembly component and such methods are within the purview of this invention.

Positive crankcase ventilation valve assembly 10 also includes a baffle 110 disposed substantially within housing 50. Baffle 110 is preferably a separate, assembled component as shown in FIGS. 2–3 and is preferably constructed from the above mentioned thermoset or thermoplastic materials. Alternatively, baffle 110 can be integrally formed as one piece with housing 50. Baffle 110 has a fist end 120 positioned within housing 50 and a second end 130 preferably extending beyond housing second end 70 and arranged to receive the positive crankcase ventilation valve 40. Alternatively, baffle second end 130 could be constructed so as to not extend beyond housing second end 70. In this alternate configuration, positive crankcase ventilation valve 40 could be assembled to either a housing inner wall 150 proximate to the housing second end 70 or to an inner baffle wall 160 proximate to baffle second end 130. In this exemplary embodiment, baffle 110 includes a circumferential groove 170 for retaining an o-ring seal 180. Seal 180 is arranged to engage housing inner wall 150 to prevent crankcase gases from escaping between baffle 110 and housing 50.

Figure 3:
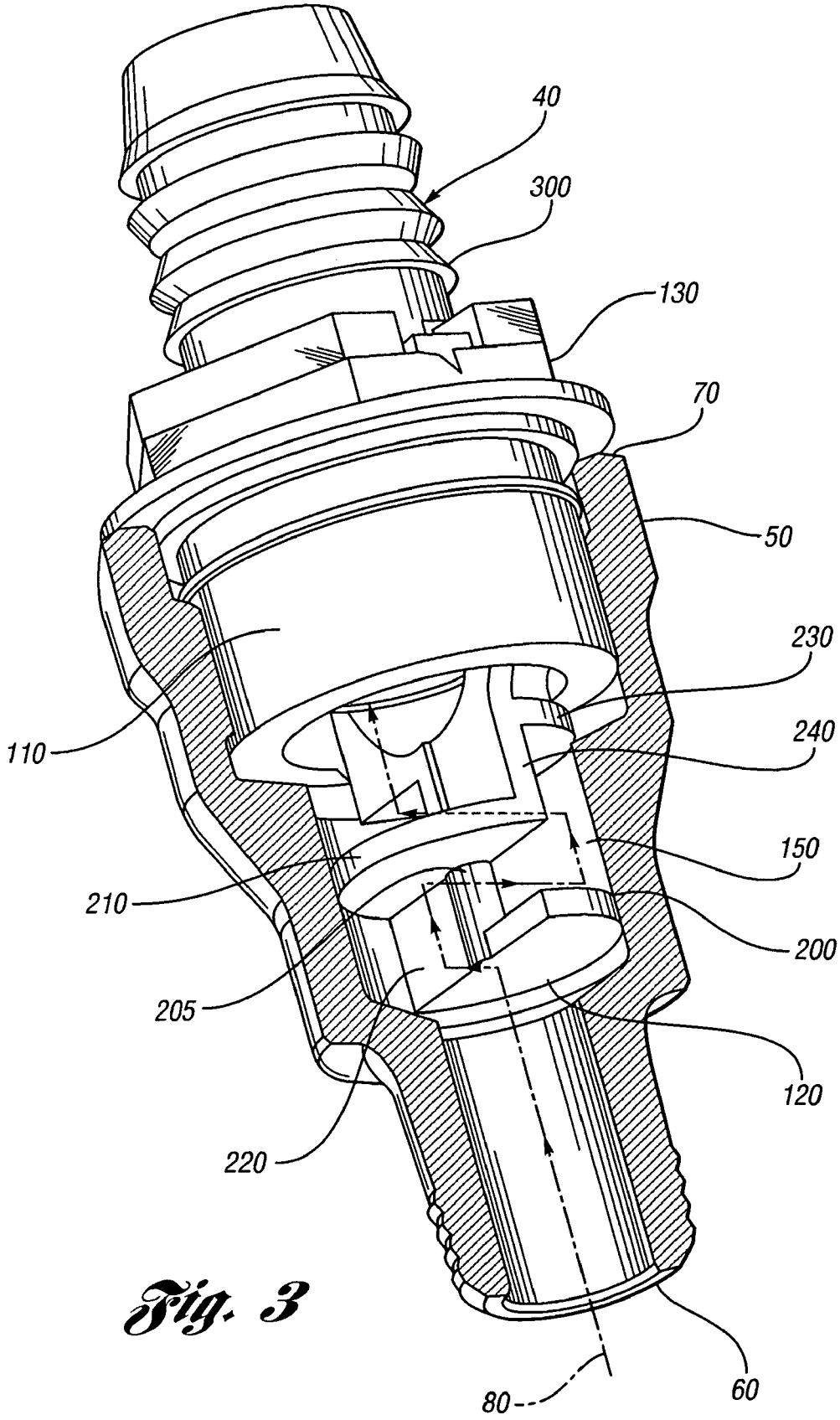
FIG. 3 illustrates a perspective view the positive crankcase ventilation valve assembly including a sectional view of the housing in accordance with the present invention.

Baffle 110 essentially requires crankcase gases entering the housing first end 60 and general flow path 80 to navigate through a spiral tortuous path starting at baffle first end 120 and continuing along an axial length of the baffle towards baffle second end 130 as best shown in FIG. 3. More specifically, crankcase gases enter housing first end 60 and general flow path 80 and then comes into contact with a first baffle flange 200. Baffle flange 200 is generally semi-circular in shape and is positioned perpendicular to an axis 205 extending along the axial length of baffle 110. Baffle flange 200 is arranged to block approximately one half of the flow path opening proximate flange 200. Thus, crankcase gases that come into contact with baffle flange 200 will be forced to change direction at approximately a ninety degree angle thereby rendering it very difficult for any oil reaching this flange to accomplish such a change in direction. The crankcase gases will then flow upward and encounter a second baffle flange 210 positioned in axial spaced relation to flange 200 as best shown in FIG. 3. Baffle flange 210 is also generally semi-circular in shape and positioned perpendicular to axis 205. Baffle flange 210 is also positioned 180 degrees opposite of baffle flange 200 as best shown in FIG. 3. In addition, a wall 220 spans from flange 200 to flange 210 as well as from axis 205 to an outside diameter of the baffle flanges. Thus, as crankcase gases are forced to navigate around baffle flange 200, the gases then travel upstream and hit baffle flange 210. Baffle flange 210 forces the crankcase gases to again negotiate a ninety degree redirection and wall 220 forces a portion of the crankcase gases to also navigate around the wall in a spiral fashion to continue traveling upstream and provides further difficulty for any oil attempting to navigate this flow path.

As the crankcase gases continue to flow upstream, they will next encounter a third baffle flange 230 positioned in axial spaced relation from second baffle flange 210. Baffle flange 230 is also generally semi-circularly shaped and positioned 180 degrees opposite of baffle flange 210 and thus in the same rotational orientation as baffle flange 200. In addition, wall 240 connects baffle flanges 210 and 230 in a similar fashion as wall 220 connects baffle flanges 200 and 210. However, wall 240 is positioned on an opposite side of axis 205 as wall 220. Baffle flanges 200, 210 and 230 are also arranged to have their arcuate portion substantially mate with housing inner wall 150 to substantially prevent any flow between the respective interface. Thus, the resultant effect of the strategic orientation of the baffle flanges and walls along axis 205 of baffle 110 is the creation of a tortuous spiral flow path for crankcase gases requiring the gases to navigate several ninety degree re-directions that any oil entering housing first end 60 will not be able to successfully navigate and thus will not be able to reach positive crankcase ventilation valve 40. Any oil that does enter housing first end 60 will be effectively blocked by baffle 110 and drain back into the engine.

Positive crankcase ventilation valve 40 is assembled to baffle second end 130 as best shown in FIG. 2. Positive crankcase ventilation valve 40 can be an existing positive crankcase ventilation valve and is preferably a valve with freeze resistant characteristics such as that disclosed in commonly owned U.S. Pat. No. 6,820,601 which is hereby incorporated by reference in its entirety. Positive crankcase ventilation valve 40 has a housing 300 with a first end 310 and a second end 320. Housing first end 310 has an indentation 330 arranged to mate with baffle protrusion 340 such that positive crankcase ventilation valve 40 is affixed to baffle 110 in a snap-fit configuration. Valve housing first end 310 also includes a circumferential groove 350 for retaining an o-ring seal 360. Seal 360 is arranged to engage baffle inner wall 160 to prevent crankcase gases from escaping between valve housing first end 310 and baffle inner wall 160. Positive crankcase ventilation valve housing second end 320 is configured to receive hose 25 for connection to intake manifold 30.

In operation, the positive crankcase valve assembly provides a compact assembly that effectively prevents oil from traveling beyond the baffle and into the positive crankcase ventilation valve, the hose and into the intake manifold. The baffle provides a torturous path for the crankcase gases to navigate, forcing the gases to encounter several barriers that each requires a flow of the gases to change direction by ninety degrees. These barriers are positioned such that the flow of the gases is required to in essence follow a spiral path around a centerline of the baffle to reach the positive crankcase ventilation valve. Any oil that enters the first end of the housing will hit the barriers, not be able to go any further towards the positive crankcase ventilation valve, and then drain back into the engine.

Thus this assembly provides for greater engine design flexibility with respect to existing positive crankcase ventilation systems. More specifically, existing systems often have to locate the positive crankcase valve where there will not be a potential for oil to enter the valve or incorporate shields or deflectors into engine components such as cylinder heads or cylinder head covers so as to prevent oil from entering the valve. These limitations significantly limit where existing systems can effectively position the valves. In addition, the above-mentioned locations are often spaced away from the engine such that the positive crankcase ventilation valves are prone to freezing due to inherent moisture residue from the crankcase gases.

Contrariwise, the positive crankcase ventilation valve assembly of the present invention includes a compact, integrated baffle arrangement that eliminates any requirement for external shields or deflectors to be incorporated into the engine. Thus, the present invention provides much improved design flexibility in where the valve assembly can be packaged. And, with this increased design flexibility, the valve assembly can be located in closer proximity to the radiant heat and hot gases of the engine and will be, by design, less susceptible to freezing.

The foregoing description constitutes the embodiments devised by the inventors for practicing the invention. It is apparent, however, that the invention is susceptible to modification, variation, and change that will become obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

What is claimed is:

1. A positive crankcase valve assembly for venting crankcase gases from an engine, the assembly comprising:

a housing having a first end and a second end, a longitudinal axis extending between the first end and the second end, and a flow path extending along the longitudinal axis between the first end and the second end; and a baffle positioned substantially within the housing and in fluid communication with the housing flow path and including a first semi-circular baffle flange positioned substantially perpendicular to the longitudinal axis and a second semi-circular baffle flange positioned substantially perpendicular to the longitudinal axis, the first semi-circular baffle flange cooperating with the second semi-circular baffle flange to induce a swirl to crankcase gases flowing along the flow path and through baffle.

2. The positive crankcase valve assembly of claim 1, wherein the assembly further comprises a seal positioned between the housing and the baffle and arranged to prevent crankcase gases from escaping from the housing.

3. The positive crankcase valve assembly of claim 2, wherein the seal comprises an o-ring seal.

4. The positive crankcase valve assembly of claim 1, wherein the housing is adapted to be attached to the engine at the housing second end.

5. The positive crankcase valve assembly of claim 1, wherein the housing comprises a plastic housing.

6. The positive crankcase valve assembly of claim 1, wherein the housing comprises a thermoset plastic housing.

7. The positive crankcase valve assembly of claim 1, wherein the housing comprises a thermoplastic housing.

8. The positive crankcase ventilation valve assembly of claim 1, further comprising a positive crankcase ventilation valve positioned relative to the housing second end and in fluid communication with the housing flow path.

9. The positive crankcase valve assembly of claim 8, wherein the baffle includes an end that extends beyond the housing first end and is arranged to receive the positive crankcase ventilation valve.

10. The positive crankcase valve assembly of claim 9, wherein the positive crankcase ventilation valve includes a circumferential groove positioned on an outer diameter of the housing and arranged to receive an o-ring seal.

11. The positive crankcase valve assembly of claim 10, wherein the o-ring seal is arranged to engage the baffle and prevent any crankcase gases from escaping between the baffle and the positive crankcase ventilation valve.

12. The positive crankcase ventilation valve assembly of claim 8, wherein the positive crankcase ventilation valve is arranged to receive a hose for routing crankcase gases to an intake manifold.

13. The positive crankcase ventilation valve assembly of claim 1, wherein the baffle further comprises:

a first end positioned proximate the housing first end;

a second end positioned proximate the housing second end; and a support member substantially spanning from the baffle first end to the baffle second end having the first baffle flange and the second baffle flange attached to the support member and spaced apart from one another along the longitudinal axis.

14. The positive crankcase ventilation valve assembly of claim 12, wherein the first baffle flange and the second baffle flange are attached to the support member at a substantially right angle.

15. The positive crankcase ventilation valve assembly of claim 13, wherein the first baffle member is positioned relative to the second baffle member to create a tortuous flow path between the first end of the housing and the second end of the housing.

16. The positive crankcase ventilation valve assembly of claim 14, wherein each of the first baffle flange and the second baffle flange includes an arcuate portion disposed adjacent to an inner circumferential wall of the housing preventing crankcase gasses from traveling between the arcuate portion of the first baffle flange and the inner circumferential wall of the housing and between the arcuate portion of the second baffle flange and the inner circumferential wall of the housing.

17. The positive crankcase ventilation valve assembly of claim 1, wherein the first semi-circular baffle flange is positioned substantially 180 degrees from the second baffle flange.

* * * * *